United States Patent [19]

Dixon

[11] Patent Number: 4,776,166

[45] Date of Patent: Oct. 11, 1988

[54] FREE PISTON POWER UNIT WITH RELIEVED FACE BOUNCE CYLINDERS

[75] Inventor: Michael Dixon, Long Beach, Calif.

[73] Assignee: Allied-Signal, Inc., Los Angeles, Calif.

[21] Appl. No.: 137,789

[22] Filed: Dec. 23, 1987

[51] Int. Cl.[4] ..... F02B 71/04

[52] U.S. Cl. ..... 60/595; 123/46 R; 417/380

[58] Field of Search ..... 60/595, 596, 597, 624, 60/910; 123/46 R, 46 B, 46 E; 417/364, 380

[56] References Cited

U.S. PATENT DOCUMENTS

| | | | |
|---|---|---|---|
| 1,908,474 | 5/1933 | Dewees . | |
| 2,101,412 | 12/1937 | Pescara . | |
| 3,134,372 | 5/1964 | Braun . | |
| 3,500,804 | 3/1970 | Braun | 123/46 R |
| 4,308,720 | 1/1982 | Brandstadter . | |

OTHER PUBLICATIONS

U.S. Publication Ser. No. 381,656; published 6/15/1943 under Alien Property Custodian Law; Franz Neugebauer.

*Primary Examiner*—Stephen F. Husar

*Attorney, Agent, or Firm*—J. H. Muetterties; J. W. McFarland; D. B. Abel

[57] ABSTRACT

An improved free piston power unit includes a pair of power pistons at opposite ends of a common power cylinder, wherein the power pistons are linked for reciprocation in unison in opposite directions. The power pistons carry a respective pair of compressor pistons disposed within compressor cylinders to generate a supply of compressed air or the like upon power piston reciprocation. The power pistons further cooperate with a respective pair of gas-containing bounce cylinders which provide pneumatic reaction forces to return the power pistons through a compresion stroke at the conclusion of a combustion expansion stroke. The bounce cylinders each have a relieved end face to provide an increased minimum bounce cylinder volume thereby limiting the maximum pressure and temperature to which the bounce cylinders are subjected, without requiring increase in the overall envelope size for the power unit.

20 Claims, 1 Drawing Sheet

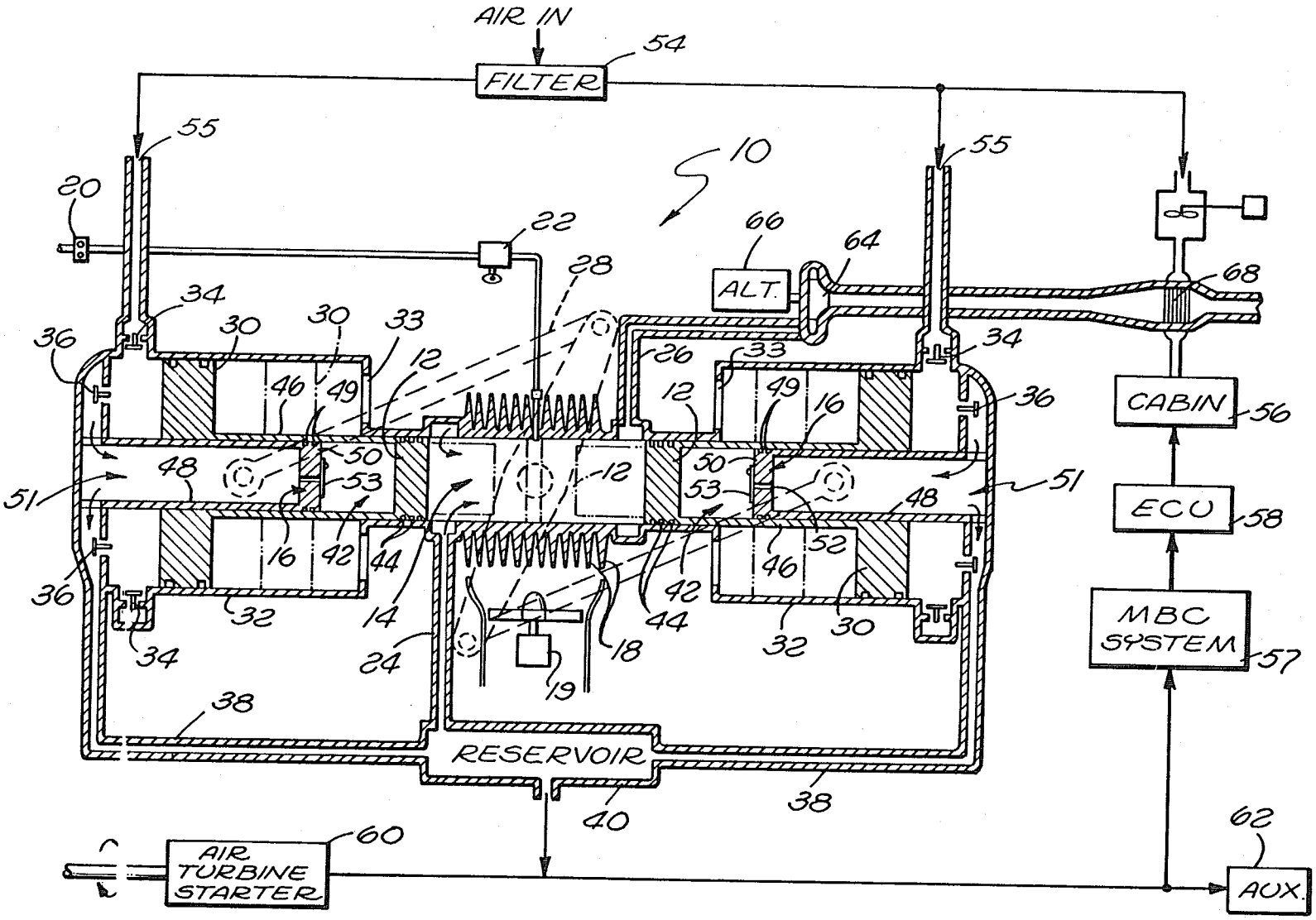
AIR IN
FILTER
54
55
ALT.
66
64
68
CABIN
56
ECU
58
MBC SYSTEM
57
AUX.
62
RESERVOIR
40
AIR TURBINE STARTER
60
10
12
14
16
18
19
20
22
24
26
28
30
32
33
34
36
38
42
44
46
48
49
50
51
52
53

FREE PISTON POWER UNIT WITH RELIEVED FACE BOUNCE CYLINDERS

BACKGROUND OF THE INVENTION

This invention relates generally to improvements in free piston power units of the type having a pair of power pistons linked for reciprocatory movement in opposite directions at the opposite ends of a common power cylinder. More particularly, this invention relates to an improved free piston power unit having specially contoured bounce cylinders designed for providing pneumatic reaction forces to return the power pistons through a compression stroke while protecting against undesirably high pressures or resultant high temperatures, and further while permitting the entire power unit to fit within a compact overall envelope size.

Free piston power units in general are well known in the art to include a pair of power pistons mounted for reciprocatory movement within the opposite ends of a common, open-ended power or combustion cylinder. The two power pistons are mechanically linked in a suitable manner for reciprocation together in opposite directions within the power cylinder to expand or contract the volume of the power cylinder. A typical free piston machine is adapted for two stroke operation wherein the power pistons are displaced through an inward or compression stroke to compress a combustible mixture of fuel and air within the power cylinder, followed by combustion and power piston displacement through an outward or expansion stroke to perform useful work. In one common application of a free piston power unit, the power pistons are coupled to a respective pair of compressor pistons which are reciprocated by the power pistons within appropriate compressor cylinders to generate a supply of compressed gas, such as compressed air or the like.

In many prior art free piston power units, the addition of so-called bounce cylinder arrangements has been proposed to provide reaction forces which act at the end of an expansion or power stroke to return the power pistons through an inward compression stroke preparatory to a subsequent combustion cycle. Such bounce cylinder arrangements normally include a pair of bounce cylinders and associated bounce pistons located at coaxial outboard positions relative to the power pistons. The pistons are respectively coupled to the bounce cylinders or bounce pistons in a manner reducing bounce cylinder volume each time the power pistons are driven through an outward power stroke. A controlled quantity of gas, such as air, within each bounce cylinder is thus compressed during the outward power stroke, wherein this compressed gas within each bounce cylinder expands at the termination of the power stroke to return the power pistons through the inward compression stroke.

While bounce cylinder arrangements have beneficially enhanced the overall operating characteristics of free piston power units, such bounce cylinder arrangements undesirably increase the overall length of the machine. In the past, undesirable hign pressures or temperaures within the bounce cylinders have been addressed by utilizing bounce cylinders of extended length exposed to external cooling or by incorporation of special control systems for limiting bounce cylinder pressure. As previously stated, extending the bounce cylinder length undesirably increase overall machine size, whereas the use of special pressure control systems has been generally complex, costly, and for the most part ineffective.

There exists, therefore, a significant need for an improved free piston power unit having reaction force bounce cylinders, wherein the bounce cylinders are designed with relatively increased minimum cylinder volume to limit bounce cylinder pressures and temperatures, without increasing the overall size of the machine. The present invention fulfills these needs and provides further related advantages.

SUMMARY OF THE INVENTION

In accordance with the invention, an improved free piston power unit includes a pair of bounce cylinders for providinf pneumatic reation forces to assist in returning a pair of power pistons through an inward compression stroke following an outward power stroke. The bounce cylinders are designed with a controlled minimum volume off substantial size to prevent adverse pressure and temperature effects which could otherwise result from subjecting the bounce cylinders to excessive fluid pressures. However, the bounce cylinders do not increase the overall size or shape of the free piston power unit, thereby permitting the power unit to be used in a wide variety of specialized operating environments requiring a small size envelope.

The free piston power unit includes the pair of power pistons mounted for reciprocation within opposite ends of a common combustion or power cylinder. The power pistons are linked for movement together in opposite directions through an inward compression stroke followed by an outward expansion or power stroke. Mixed fuel and air is compressed within the power cylinder during the inward compression stroke and then combusted to drive the power pistons outwardly through the power stroke.

In the preferred form, the power pistons are coupled to a respective pair of compressor pistons which are reciprocated within a corresponding pair of valved compressor cylinders to generate a supply of compressed gas, such as air or the like. This coupling is achieved, for each power piston, by a cylindrical piston sleeve extending from the power piston in an axially outboard direction to a position outside the power cylinder for connection to the associated compressor piston. This piston sleeve is guided for reciprocatory movement upon an inner cylinder sleeve, whereby the compressor piston has a generally annular shape positioned about the guiding cylinder sleeve within the associated compressor cylinder.

Each power piston cooperates with the associated piston sleeve and cylinder sleeve to define the associated outboard-positioned bounce cylinder. In this regard, the inboard end of this bounce cylinder is defined by the outboard face of the power piston, whereas the outboard end of the bounce cylinder is defined by an end face on the cylinder sleeve. Accordingly, as the power piston moves in the outboard direction toward its outer dead point position, the volume of the bounce cylinder is reduced to compress gas therein such that the compressed gas reacts at the end of the power stroke by expanding to force the power piston through an inward compression stroke. Importantly, to prevent excessive bounce cylinder pressure or temperature, the cylinder sleeve end face is positioned in a relieved or axially outboard spaced position relative to the inboard end of the cylinder sleeve to provide an increased bounce cylinder volume when the power is at the outer dead point. This relieved position of the cylinder sleeve end face is thus positioned axially inboard relative to the outer dead point of the compressor piston such that the overall machine length is unaffected. As a result, the power unit has a highly compact size and shape.

Other features and advantages of the invention will become more apparent from the following detailed description, taken in conjunction with the accompanying drawings which illustrate, by way of example, the principles of the invention.

BRIEF DESCRIPTION OF THE DRAWING

The accompanying drawing illustrates the improved free piston power unit embodying the novel features of the invention in generally schematic form for use in a variety of field applications.

DETAILED DESCRIPTION OF THE PREFERRED EMBODIMENT

As shown in the exemplary drawing, an improved free piston unit referred to generally by the reference numeral 10 may be operated to produce a variety of pneumatic and/or electrical outputs in accordance with the particular environment of use. The free piston power unit 10 includes a pair of oppositely reciprocating power pistons 12 within a common power or combustion cylinder 14, together with a corresponding pair of bounce or rebound cylinders 16 for returning the power pistons 12 through inward compression strokes relative to the power cylinder 14. These bounce cylinders 16 are designed to have a substantial minimum volume to avoid occurrence of excessive bounce cylinder pressures or temperatures, without increasing the overall size or shape of the power unit.

The improved free piston power unit of the present invention has an overall compact size and shape to permit use in a variety of specialized environments having defined limited envelope parameters. Importantly, the power unit incorporates the bounce cylinders 16 for improved operating characteristics, particularly improved output efficiency, while insuring a compact power unit package which avoids prior art problems related to bounce cylinder overpressure and/or overheating. The compact power unit 10 may be used, for example, as a lightweight and fuel-efficient auxiliary power source for a ground combat vehicle to provide a range of different important outputs such as a compressed air supply, crew cabin heating and air conditioning, electrical power, main engine starting, etc. Any or all of these and other output functions may be provided independent of operation of a main vehicle engine to conserve overall fuel supply and to provide a comparatively quiet standing operational made with full preparedness. The power unit fits into an extremely compact overall size envelope and includes a relatively small number of parts adapted for long operational life with minimal noise and vibration.

With reference to the accompanying drawing, the free piston power unit 10 includes the power or combustion cylinder 14 having external fins 18 for traditional air cooling. A fan 19 may be provided to force cooling air over these fins 18. A fuel pump 20 provides fuel such as diesel oil or any other selected fuel to an injector pump 22 which injects metered quantities of fuel into the power cylinder 14 in timed relation to power unit operation. An engine air intake line 24 supplies air into the power cylinder 14 for admixture with the fuel and combustion, with resultant exhaust products being discharged through an exhaust conduit 26.

The two power pistons 12 are received within the open opposite ends of the power cylinder 14. These power pistons 12 are mechanically or otherwise suitably linked to each other for reciprocation in unison in opposite directions between innermost or inner dead point positions shown in dotted lines and outermost or outer dead point positions shown in solid lines. While various power piston linking arrangements will be apparent to those skilled in the art, the accompanying drawing illustrates (in dotted lines) a mechanical linkage 28 of the type depicted in U.S. Pat. No. 1,897,674, which is incorporated by reference herein.

In terms of general operation, the power pistons 12 are each joined to a respective one of a pair of compressor pistons 30 disposed for reciprocation within a pair of compressor cylinders 32. These compressor pistons 30 are reciprocated back and forth along with the power pistons 12 to produce a supply of compressed gas, such as compressed air. More particularly, the power pistons 12 are adapted to reciprocate in unison in inward directions through a compression stroke toward their inner dead point. During such motion, the power pistons 12 close off power cylinder communication with the engine air intake line 24 and the exhaust conduit 26 and further compress an air-fuel charge within the power cylinder 14. Moreover, during such motion, the compressor pistons 30 are displaced toward corresponding inner dead points (shown in dotted lines) to expand the volumes of the compressor cylinder 32, resulting in draw-in of gas such as air through appropriate one-way inlet valves 34. The inboard end of the compressor cylinders 32 are open to atmosphere through vents 33 to avoid backpressuring the compressor pistons 30 during the inward stroke. Substantially at the inner dead point, the air-fuel charge is ignited to create a rapidly expanding or exploding charge which drives the power pistons 12 as well as the compressor pistons 30 toward their respective outer dead points. During this outward motion, the compressor pistons 30 compress the gas within the compressor cylinders 32 for discharge through appropriate one-way outlet valves 36 and a charge air conduit 38 into a compressed air reservoir 40. In addition, the power cylinder 14 is reopened for communication with the exhaust conduit 26 and the air intake line 24, with a portion of the compressed air within the reservoir 40 being recirculated through the intake line 24 to supply the power cylinder 14 with a subsequent air charge which conveniently scavenges the cylinder of exhaust products.

The bounce cylinders 16 are located at the outboard ends of the power pistons 12 and are defined by cylindrical volumes or chambers 42 which vary in size in accordance with the movements of the power pistons. Functionally, these bounce cylinders 16 contain small quantities of gas such as air which is compressed as the power pistons 12 move through their outward power strokes toward the outer dead point positions. At the outer dead point, the compressed air within the bounce cylinders 16 is allowed to expand and thereby apply a inward driving force to displace the power pistons 12 through their compression stroke back toward the inner dead point positions. Piston seal rings 44 of a chrome plated steel material or the like are normally provided on the power pistons 12 to prevent significant gas linkage between the power cylinder 14 and the bounce cylinders 16.

In accordance with primary aspects of the invention, the bounce cylinders 16 are positioned inboard relative to the compressor pistons 30 to provide an overall power unit size and shape of substantially optimum minimum size. However, the bounce cylinders 16 are also designed with extended volumetric size in the minimum volume configuration to effectively limit the maximum pressure and temperature to which the bounce cylinders are exposed.

More particularly, each power piston 12 is coupled to its associated compressor piston 30 by a generally cylindrical piston sleeve 46 extending axially in an outboard direction to exit the power cylinder 14. The outboard end of this piston sleeve 46 is joined in turn to the associated compressor piston 30 of generally annular shape within the associated compressor cylinder 32. The piston sleeve 46 has an axial length governed by the stroke length of the power pistons to permit the compressor piston 30 to clear the adjacent outboard end of the power cylinder 14 when the compressor piston is in the inner dead point position. The thus-elongated piston sleeve 46 is supported or guided through the required reciprocatory stroke on an inner cylinder sleeve 48, the inboard end of which terminates as close as possible to the adjacent power piston 12 when said power piston is in the outer dead point position. In this manner, the cylinder sleeve 48 telescopically receives the piston sleeve 46 to provide a maximum length slide guide surface with minimum overall length of the power unit 10. Seal rings 49 are normally provided at the inboard end of the cylinder sleeve 48 for accurate yet sealed tracking of the piston sleeve 46 thereon.

Each cylinder sleeve 48 supports an end face 50 which closes the outboard end of the associated bounce cylinder 16. More specifically, each bounce cylinder 16 is defined cooperatively by the end face 50 and the outboard face of the adjacent power piston 12, together with the telescopically interfitting piston and cylinder sleeves 46 and 48. As the power piston 12 moves outwardly toward the outer dead point, the bounce cylinder volume 42 is reduced to compress the air therein. Importantly, to avoid unacceptably high bounce cylinder pressures or temperatures which could damage the seal rings 49 or other structures, the end face 50 is relieved to a position spaced in an axially outboard direction from the inboard margin of the cylinder sleeve 48. With this construction, the bounce cylinder 16 is provided with a substantial minimum volume irrespective of the overall short length of the power unit.

In the most preferred arrangement of the invention, the outboard sides of the bounce cylinder end faces 50 are exposed to a pressure chamber 51 in communication with the compressed air at discharge pressure within the charge air conduits 38. This compressed air pressure is coupled through a small orifice 52 in the end face 50 for passage past a one-way reed valve 53 or the like to insure minimum pressurization of the bounce cylinder to a level corresponding with the compressed air discharge pressure, when the associated power piston 12 is at its inner dead point. Such prepressurization of the bounce cylinder 16, typically to about 50 psi, improves bounce cylinder performance without resulting in excessive chamber pressure at the outer dead point of the power pistons.

The improved free piston power unit 10 may be incorporated into a variety of system environments wherein a compact and lightweight power source is desired. For example, in the context of a ground combat vehicle, an air filter 54 is normally provided along a compressor air inlet conduit 55 to ensure supply of relatively clean air to the system. The generated supply of compressed air within the reservoir 40 is advantageously used to supply intake air to the power cylinder 14. In addition, the compressed air within the reservoir 40 may be used as an air supply for a crew cabin 56. If desired, this compressed air supply may be passed through a nuclear/biological/chemical (NBC) filtration system 57 and/or into operative relation with a suitable environmental control unit (ECU) 58 for air conditioning purposes. Alternately, the compressed air supply can be used to power an air turbine starter device 60 used to start the main engine of the vehicle. Still further, the compressed air supply can be used to provide an auxiliary drive source 62 for a variety of other purposes, for example, for powering pneumatic tools or the like.

The power unit 10 further may be used to generate electrical power, for example, by circulating the discharged exhaust products through driving relation with a turbine 64 of a turbogenerator 66. In addition, if desired, the exhaust products may be circulated past a suitable dual flow heat exchanger 68 through which a fan-driven supply of incoming fresh air to the crew cabin 56 can be heated during cold weather operations. In any case, the power unit is extremely small in size, fuel efficient, and operable with low noise and vibration independently of the main vehicle engine.

A variety of further modifications and improvements to the improved free piston power unit will be apparent to those skilled in the art. Accordingly, no limitation is intended by way of the description herein and accompanying drawing, except as set forth in the appended claims.

What is claimed is:

1. A free piston power unit, comprising:

at least one power piston mounted within a power cylinder for reciprocation respectively between inner dead point and outer dead point positions;

a driven member carried by said power piston for reciprocation therewith between inner dead point and outer dead point positions; and guide means supporting said driven member during reciprocation thereof and cooperating with said power piston to define a bounce cylinder disposed at the axially outboard side of said power piston relative to said power cylinder, said bounce cylinder having a gas therein and being reduced in size to compress said gas upon power piston movement toward said outer dead point position, whereby the compressed gas reacts when the power piston reaches the outer dead point position by expanding to urge the power piston back toward the inner dead point position;

said guide means including an outboard end face defining the outboard end margin of said bounce cylinder, said outboard end face being positioned axially outboard relative to the axially inboard margin of said guide means, and axially inboard relative to the outer dead point position of said driven member.

2. The free piston power unit of claim 1 further including a piston sleeve interconnecting said power piston and said driven member, said guide means including a cylinder sleeve in sliding relation within and slidably guiding said piston sleeve, said piston sleeve and cylinder sleeve cooperating with said end face and said power piston to define said bounce cylinder.

3. The free piston power unit of claim 1 wherein said driven member is a compressor piston.

4. The free piston power unit of claim 1 further including means for prepressurizing said bounce cylinder.

5. A free piston power unit, comprising:

a power cylinder;

a pair of power pistons mounted within said power cylinder for reciprocation generally in unison in opposite directions respectively between inner dead point and outer dead point positions;

means for supplying a combustible charge of fuel and air into said power cylinder, said power pistons being driven upon combustion of said charge through outward expansion strokes from said inner dead point positions toward said outer dead positions;

a pair of compressor cylinders;

a pair of compressor pistons received respectively within said compressor cylinders;

means for coupling said pair of power pistons respectively to said pair of compressor pistons whereby said compressor pistons are reciprocated by said power pistons generally in unison in opposite directions respectively between inner dead point and outer dead point positions; and guide means for slidably guiding said compressor pistons during reciprocation thereof, said guide means cooperating with said power pistons to define a pair of bounce cylinders disposed respectively at axially outboard ends of said power pistons, said bounce cylinders having a gas therein and being reduced in size to compress the gas therein upon movement of said power pistons toward said outer dead point positions, whereby the compressed gas within said bounce cylinders reacts by expanding when said power pistons reach their outer dead point positions to urge said power pistons through inward compression strokes back toward their inner dead point positions;

each of said bounce cylinders being defined in part by an outboard end face on said guide means, said outboard end face being spaced in an axial outboard direction relative to an inboard end margin of said guide means, said outboard end face further being spaced in an axial inboard direction relative to the outer dead point position of the associated one of said compressor pistons.

6. The free piston power unit of claim 5 wherein said coupling means comprises a pair of piston sleeves each connected between a respective one of said power pistons and the associated one of said compressor pistons, said piston sleeves extending outwardly from the opposite ends of said power cylinder, and wherein said guide means comprises a pair of cylinder sleeves each received in sliding relation within and slidably guiding a respective one of said piston sleeves, each of said cylinder sleeves supporting said outboard end face for the associated bounce cylinder in a position spaced axially in an outboard direction from the inboard end margin of said cylinder sleeve.

7. The free piston power unit of claim 6 wherein said piston sleeves cooperate respectively with said guide sleeves and said pair of power pistons to define said bounce cylinders.

8. The free piston power unit of claim 6 further including seal rings carried by said cylinder sleeves for slidably tracking said piston sleeves.

9. The free piston power unit of claim 8 further including additional seal rings carried by said power pistons.

10. The free piston power unit of claim 6 further including valve means associated with said compressor cylinders such that said compressor pistons function upon reciprocation thereof to draw in and compress a selected gas for discharge from said compressor cylinders, and a reservoir for receiving said compressed gas.

11. The free piston power unit of claim 10 further including means for communicating the compressed gas within said reservoir to said bounce cylinders.

12. The free piston power unit of claim 11 wherein said compressed gas is air.

13. The free piston power unit of claim 11 wherein said outboard end face for each of said bounce cylinders has a port formed therein and further includes a one-way valve member for permitting gas to flow through said port into said bounce cylinder.

14. The free piston power unit of claim 10 wherein the selected gas is air, said fuel and air supplying means including means for coupling a portion of the compressed air within said reservoir to said power cylinder.

15. The free piston power unit of claim 5 further including exhaust gas discharge means for exhausting products of combustion from said power cylinder, and turboalternator means driven by exhausted products of combustion to provide a source of electrical power.

16. A free piston power unit, comprising:

a power cylinder;

a pair of power pistons mounted within said power cylinder for reciprocation generally in unison in opposite directions respectively between inner dead point and outer dead point positions;

means for supplying a combustible charge of fuel and air into said power cylinder, said power pistons being driven upon combustion of said charge through outward expansion strokes from said inner dead point positions toward said outer dead positions;

a pair of compressor cylinders;

a pair of compressor pistons received respectively within said compressor cylinders;

a pair of piston sleeves connected respectively to said power pistons and extending therefrom in axially outboard directions relative to said power cylinder to exit said power cylinder, said pair of piston sleeves being connected respectively to said pair of compressor pistons whereby said compressor pistons are reciprocated by said power pistons generally in unison in opposite directions respectively between inner dead point and outer dead point positions;

a gas supply coupled to said compressor cylinders;

a compressed gas reservoir;

valve means associated with said compressor cylinders such that said compressor pistons draw the gas supply into said compressor cylinders upon compressor piston movement toward their inner dead point positions, and compress the gas supply and discharge the compressed gas supply to said reservoir upon compressor piston movement toward their outer dead point positions;

a pair of guide sleeves respectively received within and slidably guiding said piston sleeves; and a pair of end face members mounted respectively within said guide sleeves each in a position spaced axially outboard with respect to the inboard end margin of the associated guide sleeve and axially inboard relative to the outer dead point of the associated compressor piston;

said piston sleeves and said guide sleeves cooperating with said end face members and said power pistons to define a pair of bounce cylinders at the outboard ends of said power pistons, each of said bounce cylinders being reduced in size upon movement of power pistons toward their outer dead point positions.

17. The free piston power unit at claim 16 wherein said power cylinder and said guide sleeves are generally coaxially oriented.

18. The free piston power unit of claim 16 further including means for communicating the compressed gas within said reservoir to said bounce cylinders.

19. The free piston power unit of claim 18 wherein said communicating means includes a port formed in each of said end face members, and a one-way valve member associated with each of said end face members to permit one-way gas flow into said bounce cylinders.

20. The free piston power unit of claim 16 wherein the compressed gas is air.

* * * * *